US007145585B2

(12) United States Patent
Sogabe

(10) Patent No.: US 7,145,585 B2
(45) Date of Patent: Dec. 5, 2006

(54) LINE THERMAL HEAD PRINTER DEVICE

(75) Inventor: Masuo Sogabe, Fuchu (JP)

(73) Assignee: Daisey Machinery Co., ltd., Saltama-Ken (JP)

( * ) Notice: Subject to any disclaimer, the term of this patent is extended or adjusted under 35 U.S.C. 154(b) by 254 days.

(21) Appl. No.: 10/921,231

(22) Filed: Aug. 19, 2004

(65) Prior Publication Data

US 2005/0122387 A1 Jun. 9, 2005

(30) Foreign Application Priority Data

Dec. 9, 2003 (JP) ..... 2003-410085

(51) Int. Cl.
*B41J 29/02* (2006.01)

(52) U.S. Cl. ..... 347/222; 400/693

(58) Field of Classification Search ..... 347/222; 400/693, 693.1

See application file for complete search history.

(56) References Cited

U.S. PATENT DOCUMENTS 5,052,832 A 10/1991 Akiyama et al.
5,260,716 A 11/1993 Maslanka
5,853,254 A * 12/1998 Inakoshi et al. ..... 400/207
6,232,993 B1 * 5/2001 Kobayashi et al. ..... 347/175
2002/0094222 A1 * 7/2002 Furuya et al. ..... 400/615.2
2004/0208682 A1 * 10/2004 Akaiwa et al. ..... 400/613

FOREIGN PATENT DOCUMENTS

EP 1 253 018 A1 10/2002
JP 7-290805 11/1995

* cited by examiner

*Primary Examiner*—Huan Tran
(74) *Attorney, Agent, or Firm*—Wenderoth, Lind & Ponack, L.L.P.

(57) ABSTRACT

A line thermal head printer device of which size is made remarkably smaller is provided. A stepping motor (10) rotationally driving a ribbon tape reel is arranged to be fitted to one corner portion of a frame plate (9). A line thermal head (11) is arranged to be fitted to a corner portion of the frame plate (9) adjacent to this one corner portion. A ribbon tape winding drive shaft (2) and a ribbon tape unwinding drive shaft (1) are arranged on one side of the stepping motor (10) and the line thermal head (11), respectively, to be fitted to the frame plate (9). By this arrangement, parts and components are efficiently arranged without unused space on a surface of the frame plate (9) of a square or rectangular shape. Also, a ribbon tape (3) fed between reels fitted to the drive shafts (1, 2) is led around the parts and components, that is, along a periphery of the frame plate (9). Thereby, the parts and components are effectively arranged on the surface of the frame plate (9) and the construction can be made remarkably smaller.

6 Claims, 6 Drawing Sheets

LINE THERMAL HEAD PRINTER DEVICE

BACKGROUND OF THE INVENTION

1. Field of the Invention

The present invention relates to a printer device, especially a compactly made printer device, that performs printing of letters and marks on a print object sheet by using a hot release type thermal transfer ribbon tape and a line thermal head.

2. Description of the Prior Art

In recent years, as an information of packaged goods indicated on a packaging material, there are often cases where letters and marks, such as date of manufacture, tastable time period, series number of manufacture, etc. are printed differently for each object sheet to be printed (herein referred to as a print object sheet). In such cases, the printing is often done by using a hot release type thermal transfer ribbon tape and a line thermal head.

As the printing is carried out in the manufacturing process of the packaged goods, that is, for example, in the process to package the goods, the printer device used therefor is required to be made smaller in size so as to be easily fitted without obstruction in the space of machine arrangement of the packaged goods manufacturing apparatus. In addition to this, the printer device is required to be of a simplified construction, because the printer device, as a device not directly taking part in the manufacture itself of the packaged goods, is strongly desired to be made less costly.

A line thermal head printer device comprises a line thermal head, a ribbon tape unwinding drive shaft supporting a reel of a hot release type thermal transfer ribbon tape and unwinding the ribbon tape to be fed, a ribbon tape winding drive shaft winding the ribbon tape after it has been unwound and used for the printing, a stepping motor rotationally driving these drive shafts and a guide roll guiding the ribbon tape so that the ribbon tape, after unwound, is again wound up. The arrangement of these parts and components gives a large influence on the size of the printer device.

FIG. 5 is a plan view showing a constructional example of a prior art line thermal head printer device. In FIG. 5, numeral 41 designates the ribbon tape unwinding drive shaft and numeral 42 the ribbon tape winding drive shaft. Numeral 44 designates a feed shaft and numeral 45 a pinch roll. Thereby, a nip for feeding a ribbon tape 43 is formed between the feed shaft 44 and the pinch roll 45. Numeral 47 designates the line thermal head and numeral 48 a platen roll. All these parts and components are arranged on, and fitted to, a frame plate 52.

A ribbon tape unwinding reel of a ribbon tape master roll 46 is coaxially fitted to the ribbon tape unwinding drive shaft 41 so that the ribbon tape master roll 46 is supported by the ribbon tape unwinding drive shaft 41 and the ribbon tape 43 is unwound from the ribbon tape master roll 46. The ribbon tape 43 unwound from the ribbon tape master roll 46 is fed by the feed shaft 44 and the pinch roll 45 and is finally wound around a ribbon tape winding reel of the ribbon tape winding drive shaft 42. The ribbon tape winding reel is coaxially fitted to, and supported by, the ribbon tape winding drive shaft 42.

The ribbon tape 43 fed from the ribbon tape master roll 46, while running, is lapped on a print object sheet 49 to be pinched together between the line thermal head 47 and the platen roll 48 so that printing is done onto the print object sheet 49. Numerals 50, 51 designate guide rolls guiding the running of the ribbon tape 43.

In this way, in the prior art line thermal head printer device, when seen on the plan view of FIG. 5, the line thermal head 47 and the platen roll 48 are arranged on the central position of the lower portion of the printer device and, on the upper position thereof, the ribbon tape unwinding drive shaft 41, the ribbon tape winding drive shaft 42, the feed shaft 44, the pinch roll 45, etc. are arranged. Also, a motor for rotationally driving the feed shaft 44 is arranged being fitted to the frame plate 52 on the reverse side of FIG. 5 so as to be directly connected to the feed shaft 44.

Thus, in the prior art line thermal head printer device, the ribbon tape unwinding drive shaft 41, the ribbon tape winding drive shaft 42, the feed shaft 44, the pinch roll 45, etc. are arranged to be placed on a flat plane and a relatively large flat space is required therefor. Also, the drive motor is arranged on the reverse side of these parts and components and a relatively large thickness or height of the device is required for such arrangement.

FIG. 6 is a plan view showing an example of a prior art line thermal head printer device in which a line thermal head is of a movable type. In FIG. 6, numeral 61 designates a ribbon tape unwinding drive shaft, numeral 62 a ribbon tape winding drive shaft and numeral 64 the line thermal head of the movable type. The line thermal head 64, while moving along a head guide 65, performs printing. Numeral 66 designates a platen and numeral 71 a motor arranged on the upper position of a frame plate 72, when seen on the plan view of FIG. 6, for feeding a ribbon tape.

In the line thermal head printer device shown in FIG. 6, a ribbon tape 63 unwound from a ribbon tape master roll 69 fitted to, and supported by, the ribbon tape unwinding drive shaft 61 is guided by tape guide rolls 67, 68 to be fed toward the platen 66. Along the platen 66, the ribbon tape 63 is lapped on a print object sheet 70 so that printing is done on the print object sheet 70 by the line thermal head 64.

In this example also in which the line thermal head is of the movable type, when seen on the plan view of FIG. 6, the line thermal head 64 is arranged on the central position of the lower portion of the printer device and, on the upper position thereof, the ribbon tape unwinding drive shaft 61 and the ribbon tape winding drive shaft 62 are arranged side by side. Also, on a further upper position thereof, the motor 71 is arranged and hence a relatively large flat space is required for the arrangement of these parts and components.

Thus, in the prior art line thermal head printer devices of both of the fixed head type and the movable head type, there is a problem that the size is large and a considerable space is needed for fitting the printer device to the surrounding apparatus and hence the printer device is currently desired to be made further smaller.

SUMMARY OF THE INVENTION

It is therefore an object of the present invention to provide a line thermal head printer device in which parts and components thereof are arranged differently from the prior art line thermal head printer device so that the size of the printer device can be made remarkably smaller.

In order to achieve the above-mentioned object, the present invention provides line thermal head printer devices constructed as follows:

(1) A line thermal head printer device comprising a frame plate as well as comprising a line thermal head, a stepping motor rotationally driving a ribbon tape reel, a ribbon tape unwinding drive shaft and a ribbon tape winding drive shaft, all fitted to the frame plate, characterized in that the stepping motor is arranged on one corner portion of the frame plate, the line thermal head is arranged on a corner portion of the frame plate adjacent to the one corner portion where the stepping motor is arranged, and the ribbon tape unwinding drive shaft and the ribbon tape winding drive shaft are arranged on one side of the stepping motor and the line thermal head so that a line connecting the stepping motor and the line thermal head inclinedly crosses with a line connecting the ribbon tape unwinding drive shaft and the ribbon tape winding drive shaft.

(2) In the line thermal head printer device as mentioned in (1) above, if the line thermal head is of a fixed type, the stepping motor is arranged such that a line along each side of a frame of a square or rectangular shape of the stepping motor is inclined relative to a line of each side of the one corner portion where the stepping motor is arranged, one of the ribbon tape unwinding drive shaft and the ribbon tape winding drive shaft is arranged on a corner portion of the frame plate adjacent to the one corner portion where the stepping motor is arranged and the other of them is arranged on one side of the line thermal head.

(3) In the line thermal head printer device as mentioned in (1) above, if the line thermal head is of a movable type, the stepping motor is arranged such that a line along each side of a frame of a square or rectangular shape of the stepping motor is parallel with a line of each side of the one corner portion where the stepping motor is arranged, one of the ribbon tape unwinding drive shaft and the ribbon tape winding drive shaft is arranged on a corner portion of the frame plate adjacent to the corner portion where the line thermal head is arranged and the other of them is arranged on one side of the stepping motor.

(4) In the line thermal head printer device as mentioned in any one of (1) to (3) above, out of two drive shafts of the ribbon tape unwinding drive shaft and the ribbon tape winding drive shaft, the ribbon tape unwinding drive shaft is arranged on one side of the line thermal head and the ribbon tape winding drive shaft is arranged on one side of the stepping motor.

According to the line thermal head printer device of the present invention mentioned in (1) above, the stepping motor and the line thermal head are arranged on one side portion of the frame plate and on one side of them on the frame plate, the ribbon tape unwinding drive shaft and the ribbon tape winding drive shaft are arranged so that the line connecting the stepping motor and the line thermal head inclinedly crosses with the line connecting the ribbon tape unwinding drive shaft and the ribbon tape winding drive shaft. Thereby, the parts and components constituting the line thermal head printer device are efficiently arranged without an unused space on the flat surface of the frame plate usually of a square or rectangular shape. Also, the ribbon tape fed between each of the reels supported to both of the drive shafts are led to run around these parts and components, that is, along the periphery of the frame plate. Thereby, the surface of the frame plate is effectively used and the construction of the parts and components can be made further compact.

According to the line thermal head printer device of the present invention mentioned in (2) above, in which the line thermal head is of the fixed type, the stepping motor is arranged such that the line along each side of the frame of the square or rectangular shape of the stepping motor is inclined relative to the line of each side of the one corner portion where the stepping motor is arranged. Thereby, the stepping motor is effectively arranged relative to the ribbon tape on the surface of the frame plate.

According to the line thermal head printer device of the present invention mentioned in (3) above, in which the line thermal head is of the movable type, the stepping motor and the line thermal head are arranged so that the line thermal head is given with a sufficient space for movement without obstruction. Moreover, the ribbon tape unwinding drive shaft and the ribbon tape winding drive shaft are arranged on one side of the stepping motor and the line thermal head. Thereby, the ribbon tape led between these drive shaft is given with a sufficient space by which the ribbon tape is stably supported.

According to the line thermal head printer device of the present invention mentioned in (4) above, the ribbon tape unwinding drive shaft is arranged on one side of the line thermal head and the ribbon tape winding drive shaft is arranged on one side of the stepping motor. Thereby, the space on the frame plate can be efficiently used for leading the ribbon tape.

In this way, according to the line thermal head printer device of the present invention, as compared with the conventional printer device, such a printer device as is made smaller in size approximately by three quarters, or approximately to a quarter, in the volumetric ratio can be provided.

DESCRIPTION OF THE PREFERRED EMBODIMENTS

Herebelow, the present invention will be described more concretely based on embodiments of a line thermal head printer device according to the present invention with reference to FIGS. 1 to 4 as appended hereto.

First Embodiment

Figure 1:
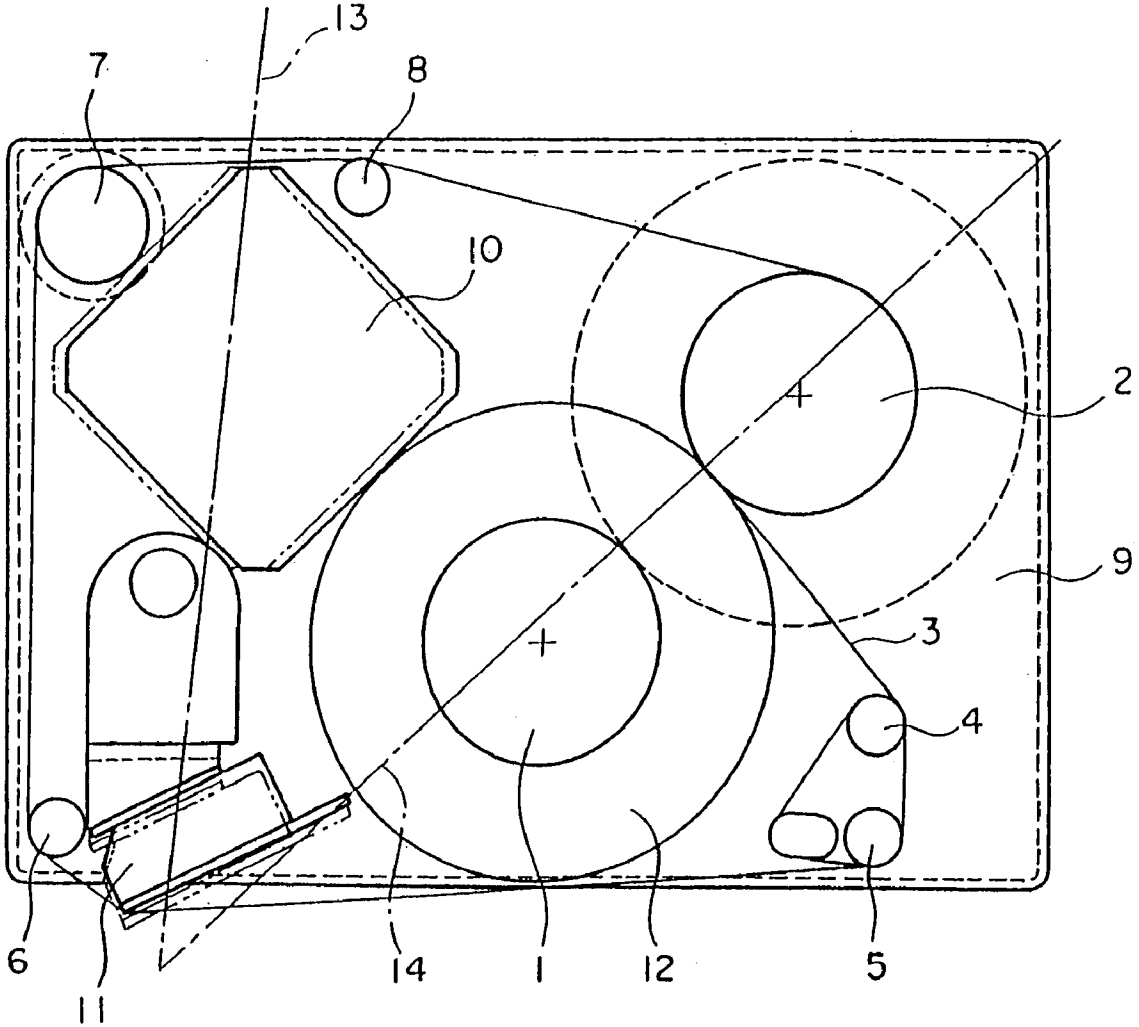
FIG. 1 is a plan view showing an arrangement of parts and components of a line thermal head printer device of a first embodiment according to the present invention.
Figure 2:
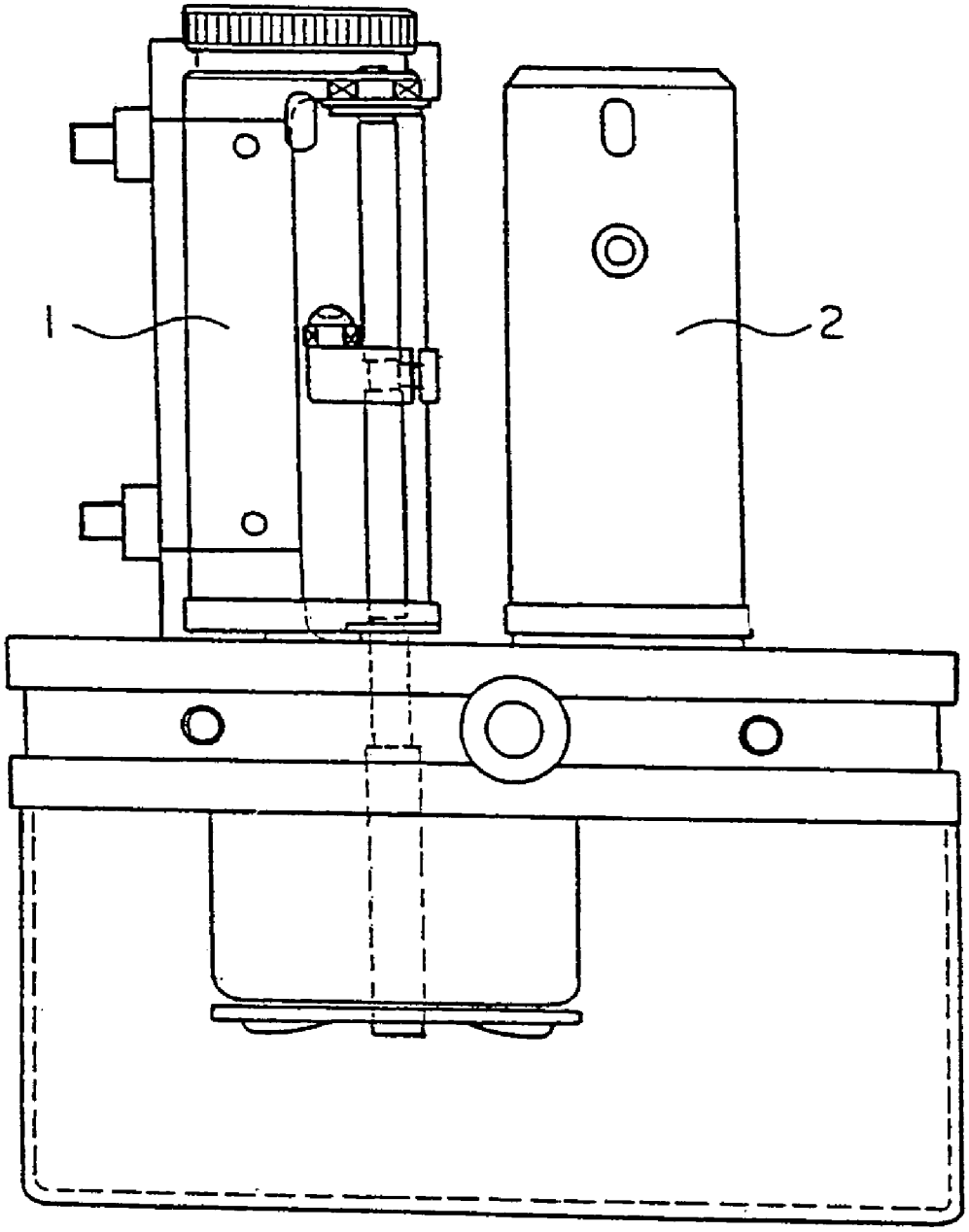
FIG. 2 is a side view, seen from the right-hand side of FIG. 1, of the line thermal head printer device of FIG. 1.

FIG. 1 is a plan view and FIG. 2 is a right-hand side view, that is, a side view seen from the right-hand side of FIG. 1, both of a line thermal head printer device of a first embodiment according to the present invention. This first embodiment is an example where the present invention is applied to a printer device having a fixed type line thermal head. In FIGS. 1 and 2, numeral 1 designates a ribbon tape unwinding drive shaft and numeral 2 a ribbon tape winding drive shaft. The ribbon tape unwinding drive shaft 1 is arranged on one side of a line thermal head 11 to be described later. The ribbon tape winding drive shaft 2 is arranged on an upper corner portion on the right-hand side of FIG. 1. On the left-hand side upper corner portion opposite to the ribbon tape winding drive shaft 2, a stepping motor 10, to be described later, is arranged.

A ribbon tape unwinding reel of a ribbon tape master roll 12 is fitted to the ribbon tape unwinding drive shaft 1 so that the ribbon tape master roll 12 is supported by the ribbon tape unwinding drive shaft 1. A ribbon tape 3 unwound from the ribbon tape master roll 12 is guided by guide rolls 4, 5, 6, 7 and 8, that are fitted to a frame plate 9, to be finally wound around a ribbon tape winding reel of the ribbon tape winding drive shaft 2. The ribbon tape winding reel is fitted to, and supported by, the ribbon tape winding drive shaft 2.

The stepping motor 10 is arranged on the left-hand side upper corner portion, as mentioned above, and functions to rotationally drive the ribbon tape unwinding drive shaft 1. The stepping motor 10 has a frame of an approximately square shape, as seen on the plan view of FIG. 1, and is fitted to the frame plate 9 so that a line along each side of the frame of the stepping motor 10 is inclined with an angle of about 45° relative to a line of each side of the left-hand side upper corner portion where the stepping motor 10 is arranged.

Also, on the left-hand side lower corner portion adjacent to the stepping motor 10, the line thermal head 11 is arranged.

Where a line 13 is drawn connecting approximately central portions of the stepping motor 10 and the line thermal head 11, respectively, and a line 14 is drawn connecting approximately central portions of the ribbon tape unwinding drive shaft 1 and the ribbon tape winding drive shaft 2, respectively, the lines 13, 14 cross with each other so that an inclined V-shape is formed by them, as shown in FIG. 1.

In the printer device of FIGS. 1 and 2, by employing the above-mentioned arrangement of the parts and components constituting the line thermal head printer device, the parts and components can be efficiently arranged in a plane of the frame plate 9 formed in a square or rectangular shape. Also, as shown in FIG. 1, the construction is made such that the ribbon tape 3 fed between the reels of the ribbon tape unwinding drive shaft 1 and the ribbon tape winding drive shaft 2 is guided to run around these parts and components, that is, along a periphery of the frame plate 9. Thereby also, the plane of the frame plate 9 is effectively used for fitting of the parts and components so that the size of the entire printer device is made further smaller.

Also, the parts and components are arranged so that the line 13 connecting the stepping motor 10 and the line thermal head 11 and the line 14 connecting the ribbon tape unwinding drive shaft 1 and the ribbon tape winding drive shaft 2 cross with each other to form the inclined V-shape. Thereby, within a size of an external shape as large as a post card, such a space arrangement of the parts and components as is able to use a ribbon tape master roll of a size beyond a maximum outer diameter of 60 mm is realized.

Further, with respect to winding of the ribbon tape, a distance of the roll arrangement between the guide roll 6 arranged immediately downstream of the line thermal head 11 and the next guide roll 7 is made larger relative to a width of the ribbon tape that is being used. Thereby, such an effect can be obtained that no influence of a winding looseness that is generated from the ribbon tape on the winding side reaches the line thermal head 11.

Second Embodiment

Figure 3:
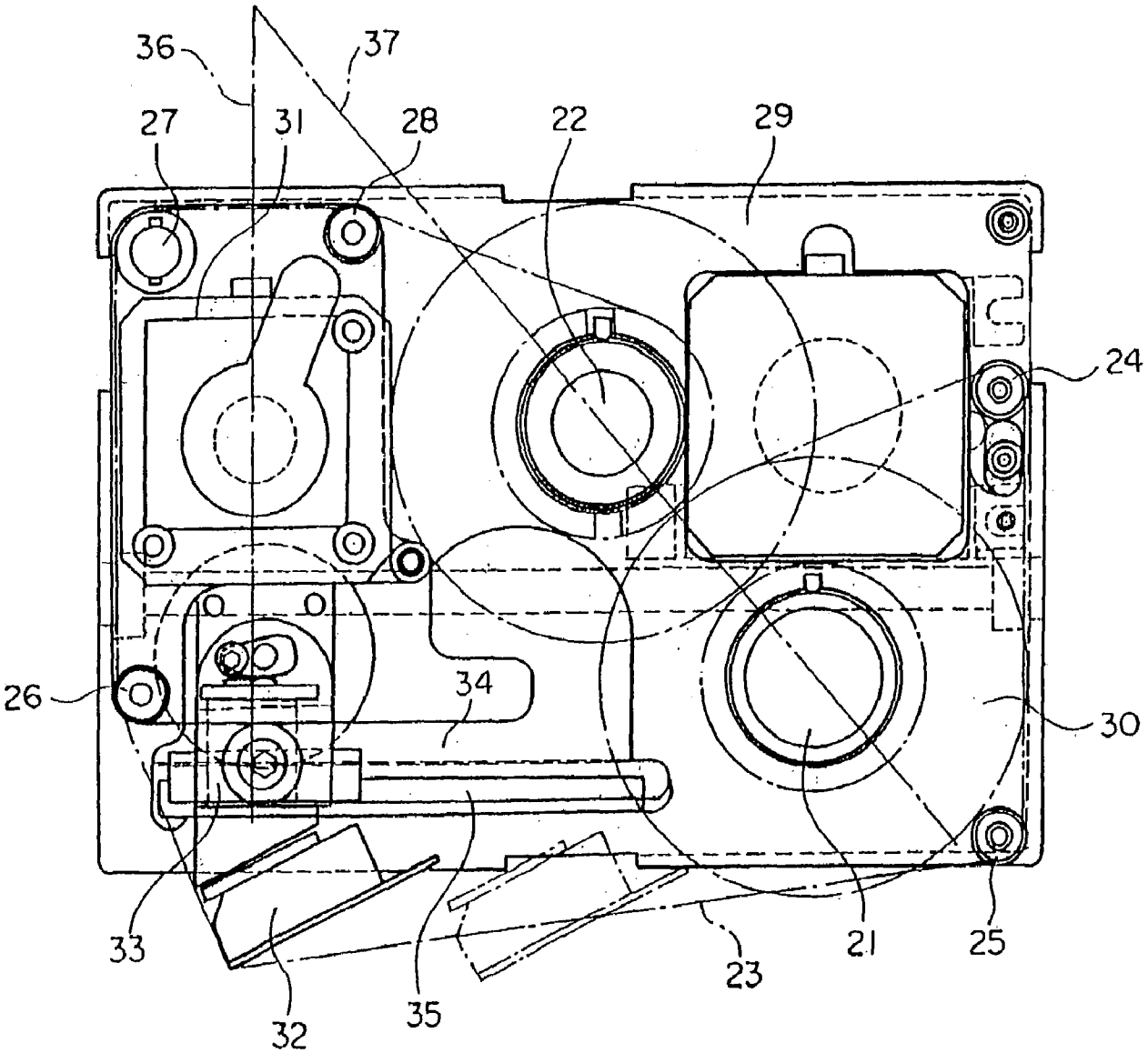
FIG. 3 is a plan view showing an arrangement of parts and components of a line thermal head printer device of a second embodiment according to the present invention.
Figure 4:
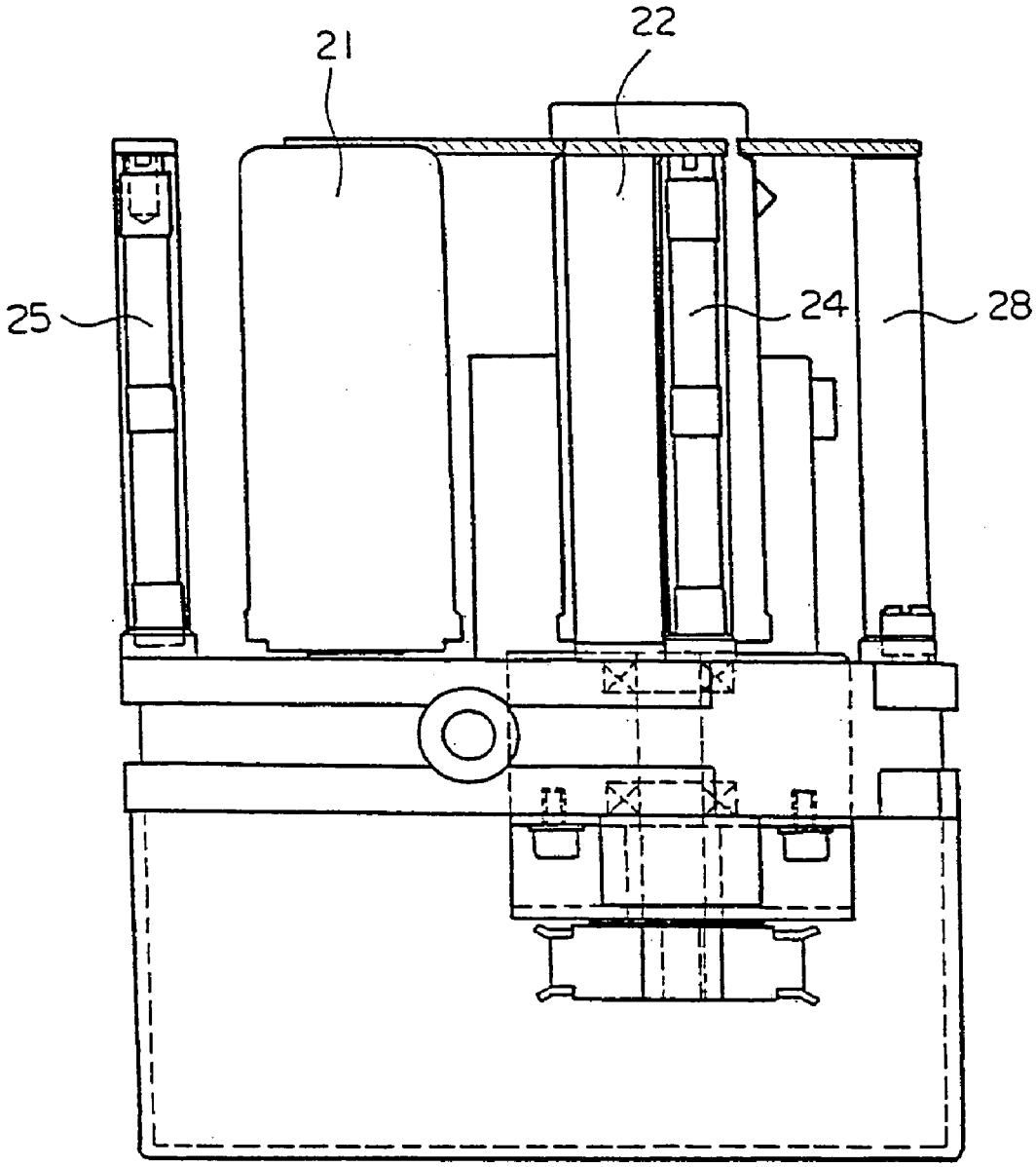
FIG. 4 is a side view, seen from the right-hand side of FIG. 3, of the line thermal head printer device of FIG. 3.
Figure 5:
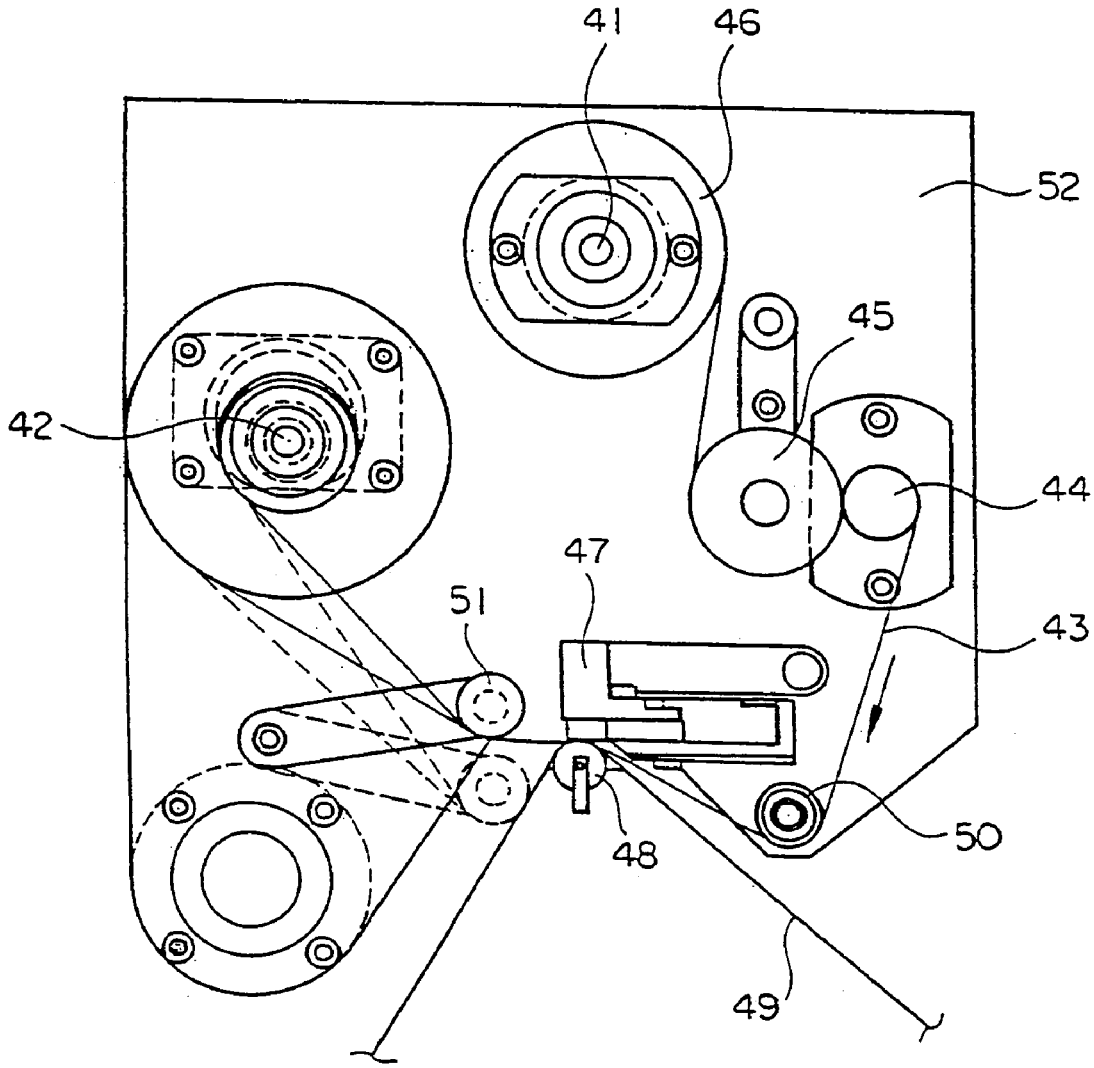
Fig. 5 (Prior Art)
FIG. 5 is a plan view showing one example of an arrangement of parts and components of a prior art line thermal head printer device.
Figure 6:
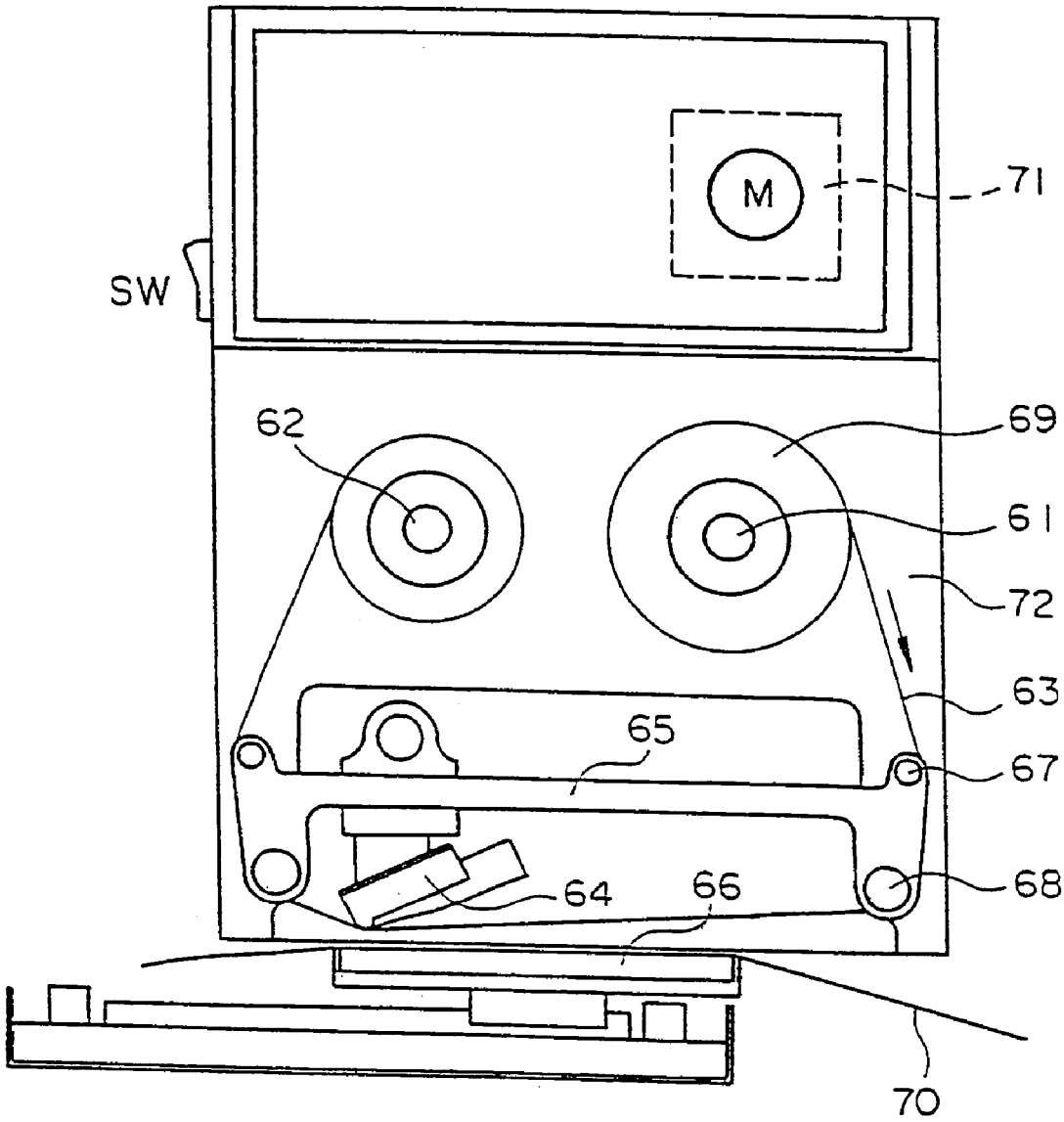
Fig. 6 (Prior Art)
FIG. 6 is a plan view showing another example of an arrangement of parts and components of a prior art line thermal head printer device.

FIG. 3 is a plan view and FIG. 4 is a right-hand side view, that is, a side view seen from the right-hand side of FIG. 3, both of a line thermal head printer device of a second embodiment according to the present invention. This second embodiment is an example where the present invention is applied to a printer device having a movable type line thermal head. In FIGS. 3 and 4, numeral 21 designates a ribbon tape unwinding drive shaft and numeral 22 a ribbon tape winding drive shaft. The ribbon tape unwinding drive shaft 21 is arranged on the right-hand side lower corner portion of FIG. 3. On the left-hand side lower corner portion opposite to the ribbon tape unwinding drive shaft 21, a line thermal head 32, to be described later, is arranged. The ribbon tape winding drive shaft 22 is arranged on the upper central portion of FIG. 3 and, on the left-hand side upper corner portion adjacent to the ribbon tape winding drive shaft 22, a stepping motor 31, to be described later, is arranged.

A ribbon tape unwinding reel of a ribbon tape master roll 30 is fitted to the ribbon tape unwinding drive shaft 21 so that the ribbon tape master roll 30 is supported by the ribbon tape unwinding drive shaft 21. A ribbon tape 23 unwound from the ribbon tape master roll 30 is guided by guide rolls 24, 25, 26, 27 and 28, that are fitted to a frame plate 29, to be finally wound around a ribbon tape winding reel of the ribbon tape winding drive shaft 22. The ribbon tape winding reel is fitted to, and supported by, the ribbon tape winding drive shaft 22.

The stepping motor 31 is arranged on the left-hand side upper corner portion, as described above, and functions to rotationally drive the ribbon tape unwinding drive shaft 21. The stepping motor 31 has a frame of an approximately square shape, as seen on the plan view of FIG. 3, and is fitted to the frame plate 29 so that a line along each side of the frame of the stepping motor is parallel with a line of each side of the left-hand side upper corner portion where the stepping motor 31 is arranged.

Also, on the left-hand side lower corner portion adjacent to the stepping motor 31, the line thermal head 32 is arranged. Numeral 34 designates a slider guide of the line thermal head 32. The slider guide 34 has a slide groove 35 along which a slider 33 supporting the line thermal head 32 slides. While the slider 33 is so sliding, printing is carried out on the print object sheet (not shown).

Where a line 36 is drawn connecting approximately central portions of the stepping motor 31 and the line thermal head 32 when it is on the left-hand side end position of the slide groove 35, respectively, and a line 37 is drawn connecting approximately central portions of the ribbon tape unwinding drive shaft 21 and the ribbon tape winding drive shaft 22, respectively, the lines 36, 37 cross with each other so that an inclined inverse V-shape is formed by them, as shown in FIG. 3.

In the printer device shown in FIGS. 3 and 4, by employing the above-mentioned arrangement of the parts and components, a sufficient space for movement of the movable type line thermal head 32 is provided as well as a sufficient space for supporting the ribbon tape fed between the ribbon tape unwinding drive shaft 21 and the ribbon tape winding drive shaft 22 is provided around the stepping motor 31 and the line thermal head 32.

Also, the parts and components are arranged so that the line 36 connecting the stepping motor 31 and the line thermal head 32 and the line 37 connecting the ribbon tape unwinding drive shaft 21 and the ribbon tape winding drive shaft 22 cross with each other to form the inclined inverse V-shape. Thereby, within a size of an external shape as large as a post card, such a space arrangement of the parts and components as is able to use a ribbon tape master roll of a size beyond a maximum outer diameter of 60 mm is realized.

Further, with respect to winding of the ribbon tape, a distance of the roll arrangement between the guide-roll 26 arranged immediately downstream of the line thermal head 32 and the next guide roll 27 is made larger relative to a width of the ribbon tape that is being used. Thereby, such an effect can be obtained that no influence of a winding looseness that is generated from the ribbon tape on the winding side reaches the line thermal head 32.

In the above, while the present invention has been described concretely based on the embodiments as illustrated, the present invention is not limited thereto but, needless to mention, may be added with variations or modifications within the scope of the claims as appended hereto.

For example, in the embodiments as illustrated, while the arrangement is made such that the ribbon tape winding drive shaft is arranged on one side of the stepping motor and the ribbon tape unwinding drive shaft is arranged on one side of the line thermal head, the arrangement may be made with the two drive shafts being reversely arranged to each other, that is, the ribbon tape unwinding drive shaft is arranged on one side of the stepping motor and the ribbon tape winding drive shaft is arranged on one side of the line thermal head.

Also, in the embodiments shown in FIGS. 1 and 3, respectively, while the stepping motors 10, 31 and the line thermal heads 11, 32 are arranged on the left-hand side of the respective figures and the ribbon tape unwinding drive shafts 1, 21 and the ribbon tape winding drive shafts 2, 22 are arranged on the right-hand side thereof, the arrangement may be made reversely thereof with respect to the left-hand side and the right-hand side.

What is claimed is:

1. A line thermal head printer device comprising a frame plate as well as comprising a line thermal head, a stepping motor rotationally driving a ribbon tape reel, a ribbon tape unwinding drive shaft and a ribbon tape winding drive shaft, all fitted to said frame plate, wherein said stepping motor is arranged on one corner portion of said frame plate, said line thermal head is arranged on a corner portion of said frame plate adjacent to said one corner portion where said stepping motor is arranged, and said ribbon tape unwinding drive shaft and said ribbon tape winding drive shaft are arranged on one side of said stepping motor and said line thermal head so that a line connecting said stepping motor and said line thermal head inclinedly crosses with a line connecting said ribbon tape unwinding drive shaft and said ribbon tape winding drive shaft.

2. A line thermal head printer device as claimed in claim 1, wherein said line thermal head is of a fixed type, said stepping motor is arranged such that a line along each side of a frame of a square or rectangular shape of said stepping motor is inclined relative to a line of each side of said one corner portion where said stepping motor is arranged, one of said ribbon tape unwinding drive shaft and said ribbon tape winding drive shaft is arranged on a corner portion of said frame plate adjacent to said one corner portion where said stepping motor is arranged and the other of them is arranged on one side of said line thermal head.

3. A line thermal head printer device as claimed in claim 1, wherein said line thermal head is of a movable type, said stepping motor is arranged such that a line along each side of a frame of a square or rectangular shape of said stepping motor is parallel with a line of each side of said one corner portion where said stepping motor is arranged, one of said ribbon tape unwinding drive shaft and said ribbon tape winding drive shaft is arranged on a corner portion of said frame plate adjacent to said corner portion where said line thermal head is arranged and the other of them is arranged on one side of said stepping motor.

4. A line thermal head printer device as claimed in claim 1, wherein two drive shafts of said ribbon tape unwinding drive shaft and said ribbon tape winding drive shaft are said ribbon tape unwinding drive shaft arranged on one side of said line thermal head and said ribbon tape winding drive shaft arranged on one side of said stepping motor.

5. A line thermal head printer device as claimed in claim 2, wherein two drive shafts of said ribbon tape unwinding drive shaft and said ribbon tape winding drive shaft are said ribbon tape unwinding drive shaft arranged on one side of said line thermal head and said ribbon tape winding drive shaft arranged on one side of said stepping motor.

6. A line thermal head printer device as claimed in claim 3, wherein two drive shafts of said ribbon tape unwinding drive shaft and said ribbon tape winding drive shaft are said ribbon tape unwinding drive shaft arranged on one side of said line thermal head and said ribbon tape winding drive shaft arranged on one side of said stepping motor.

* * * * *